United States Patent [19]

Anderson

[11] 4,409,863

[45] Oct. 18, 1983

[54] COMBINED TAB-TOP CAN OPENER

[76] Inventor: John J. Anderson, 320 Gibson, South Lyon, Mich. 48178

[21] Appl. No.: 327,102

[22] Filed: Dec. 3, 1981

[51] Int. Cl.[3] ..... B67B 7/40; B67B 7/44

[52] U.S. Cl. ..... 81/3.1 R; 81/3.46 R; 7/151; D8/40

[58] Field of Search ..... 81/3.1 R, 3.46 R, 3.34, 81/3.46 A; 7/151; D8/33, 34, 40

[56] References Cited

U.S. PATENT DOCUMENTS

| | | | |
|---|---|---|---|
| D. 258,041 | 1/1981 | Anderson | D8/40 |
| 2,860,533 | 11/1958 | Lydon | 81/3.46 R |
| 3,954,030 | 5/1976 | Newton | 81/3.46 R |
| 4,133,228 | 1/1979 | De Pooter | 81/3.1 R |
| 4,253,352 | 3/1981 | O'Neal | 81/3.46 R |

FOREIGN PATENT DOCUMENTS

| | | | |
|---|---|---|---|
| 767533 | 2/1957 | United Kingdom | 81/3.46 R |

*Primary Examiner*—Roscoe V. Parker

*Attorney, Agent, or Firm*—Irving M. Weiner; Pamela S. Burt; John L. Shortley

[57] ABSTRACT

A multiple tool opener for flip top cans or the like comprised of a single piece of readily available tubular material. The opposite ends are formed to provide, respectively, a chamber for receiving flip top can tabs or rings on one hand, and on the other hand a hook-like section which can be used in case the rings or tabs fail. The tools are made without any projecting fastening means and comprise a single unitary device without separable parts.

2 Claims, 9 Drawing Figures

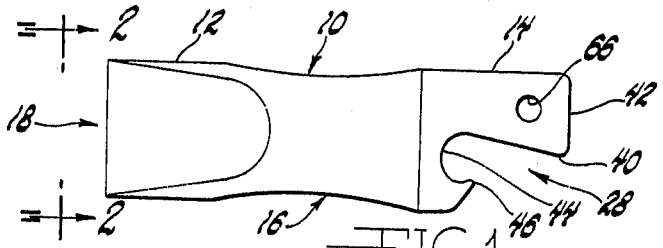
FIG.1
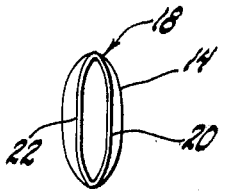
FIG.2
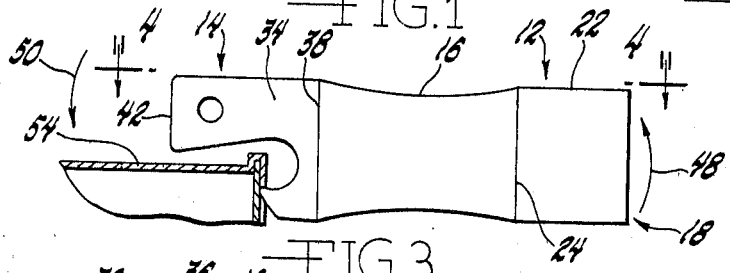
FIG.3
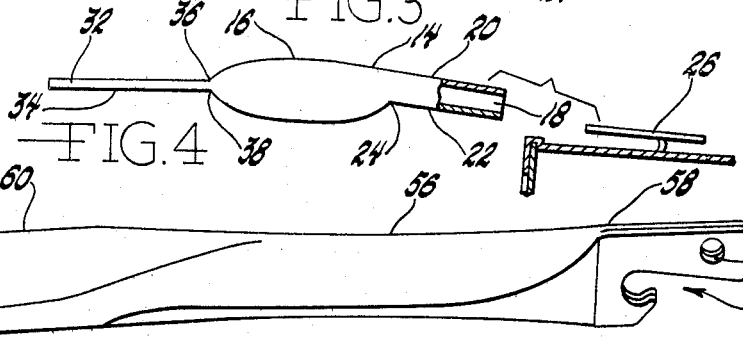
FIG.4
FIG.5
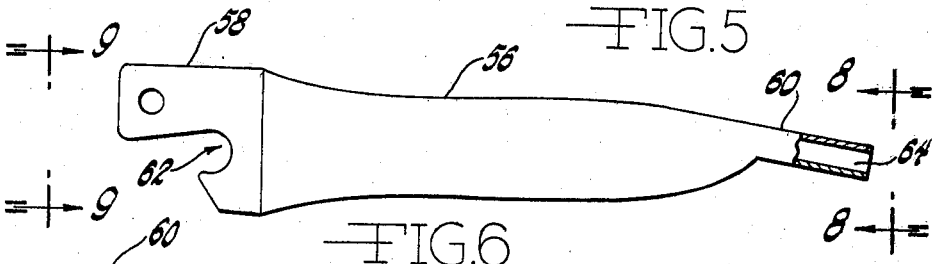
FIG.6
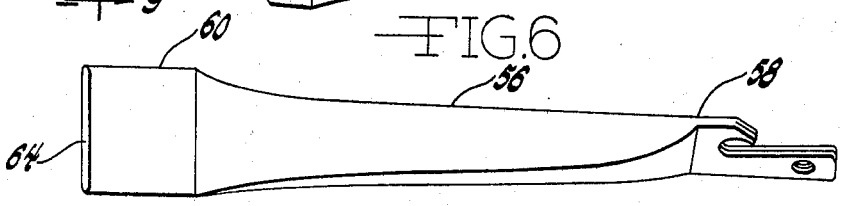
FIG.7
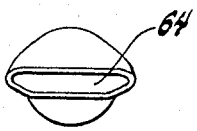
FIG.8
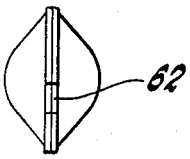
FIG.9

COMBINED TAB-TOP CAN OPENER

FIELD OF THE INVENTION

This invention relates to an opener for cans and the like containers having "flip tops" such as rings and tab-like members which are associated with stress bound portions which latter portions will swing open when pressure is exerted upon them.

BACKGROUND OF THE INVENTION

There has come onto the market fluid containers for containing soft drinks, beer and the like which have tabs or rings which can either be grasped or pressed in such a manner as to bear against prestressed sections on the can so as to form an opening through which the fluid can be poured or sipped.

It is somewhat difficult for some people to open such cans. This is particularly apt to be true for those who have long nails and do not care to endanger them. In other instances the rings or tabs may break loose without sufficiently depressing the skin of the container to cause the necessary rupture and/or without opening the can sufficiently.

There are known in the art openers which are used for puncturing cans and for opening bottle tops. There has also been attempted can and pull tab type openers. One of the latter is illustrated in U.S. Pat. No. D. 258,041 granted Jan. 27, 1981 to Anderson. With reference to the drawings of the latter patent, it will be noticed that there is disclosed an opener which is shaped very similarly to a single bladed knife. A blade section extends from one side or end to the other, and a handle is provided at one end. The blade extends between a pair of handle forming pieces, and is attached to the latter by one or more rivet-like members. The blade is formed of a single blade of material which has a series of openings. One of the openings apparently can be used for puncturing cans and it would seem that the other can be used to open the lids of flip top cans.

This patent is a design patent and its exact method of operation is not fully disclosed.

Another example of the type of double use tools in the prior art is shown in a catalog entitled the "Harriet Carter" catalog published by the Harriet Carter Company of North Wales, Pa. On page 20 of this catalog, in the upper left hand corner, there is shown a bottle opener which comprises a ring-like means at one end and a claw-like means at the other. Such an opener is used for the caps on bottles, but might conceivably be also used in puncturing a can.

SUMMARY OF THE INVENTION

According to the instant invention there is provided a bottle opener which is adapted to securely receive a ring or flip top tab of a can in such a manner that by simple rotation i.e., by upward or downward swinging movement, of the tool, the ring or tab will force the can to open.

Further, according to the instant invention there is provided a second tool-like section which can be used in the event the rings or tabs fail. In this instance the device can be used in a manner such as to exert the needed pressure on the pretensioned section of the can so that it will open properly.

Further according to the invention, the opener is made from a single piece of a tubular member. One end of the tubular member is deformed to form a flat projecting part. The latter part is then cut to provide a hook-like opener which can be used to exert pressure upon the pretensioned section of a can utilizing the can edge as a pivot point. The opposite end of the tubular member is deformed to form a projecting section having an opening that is adapted to receive the rings or hooks of tabs of flip top cans. The latter section is deformed to sufficiently cause the opening in the tubular member to extend beyond the width of the pop top ring or tab, yet the deformation does not close the tube. The tube is formed so as to provide a chamber of an oblong shape which has a greater width in one direction then the normal width of the flat rings or tabs that may be encountered upon cans. In its transverse direction the tubular member has only an opening large enough to ensure a good purchase on the ring or tab; whereby the latter can be swung upwardly by pivoting the opener in a plane perpendicular to the can top.

The formation of the opening device from a single piece of tubular member is also a significant characteristic of the invention. Separate elements which must be screwed, pinned or otherwise connected are avoided. Also the need for separate handle sections which must be connected to relatively thin and sharp sections is avoided. According to the invention a basically seamless construction is provided which is smooth to the touch, has no projecting edges and does not employ any separate sections which can become detached. Further, the method of forming the double tool member is simplified greatly.

According to the invention there is provided an opener for can tops having tabs or rings for opening of the cans to which they are attached by mechanical action, comprising a hollow tubular member having a first section formed by flattening the tube, for a distance extending from the end of said first section inwardly towards the opposite end of said tubular member, to form a first pair of facing substantially parallel members. The opener further comprises a second section formed by flattening said tubular member for a distance extending from the opposite end of the tubular member inwardly of the tubular member to form a second pair of facing substantially parallel members.

The invention further comprises the concept of the facing members of one of said sections being in contact throughout substantially their entire length to form a substantially solid extension from said tubular member, while the other of said sections has its facing members in spaced parallel relation to each other to form a hollow elongated chamber extending a substantial distance inwardly of the latter end.

Further according to the invention there is provided a chamber of oblong shape sized to closely receive a member such as a pull tab or a ring, which is relatively thin in one direction and substantially elongated at right angles thereto so as to provide a relatively thin ring or tab respectively.

Further according to the invention there is provided a handle section intermediate the first and second mentioned sections. The first and second mentioned sections form extensions of the handle section and are integral therewith, in effect being specially formed projections of the handle sections.

According to the invention one of the sections which projects outwardly from the handle section has a hook-like recess formed by a ledge-like portion extending from an outer end of the latter section inwardly substantially parallel to the major axis of the tubular member forming the tool. The ledge-like portion merges into a re-entrantly curved portion terminating in a second ledge-like section extending substantially parallel to the first. The latter ledge-like section terminates inwardly from the adjacent end a substantial distance, the whole forming a hook-like indentation. The other of the sections of the tool forms an oblong chamber for receiving a member such as the pop top can tab.

BRIEF DESCRIPTION OF THE DRAWINGS

FIG. 1 is a plan view of a preferred form of the invention.

FIG. 2 is a side view taken along line 2—2 of FIG. 1.

FIG. 3 is a bottom plan view of the tool of FIG. 1 and showing the manner in which it may be used with containers having flip-like top opening means.

FIG. 4 is a side elevational view partly in section, showing again, the manner in which the opener may be used.

FIG. 5 is a side view of a second form of an opener with the opener canted along its longitudinal axes.

FIG. 6 is a side elevational, partly sectioned, view of the opener of FIG. 5.

FIG. 7 is another side view of the opener of FIG. 5 showing it canted 180° from the position in which it appears in FIG. 5.

FIG. 8 is an end view taken along line 8—8 of FIG. 6.

FIG. 9 is an end view taken along line 9—9 of FIG. 6.

DETAILED DESCRIPTION OF THE DRAWINGS

As shown in FIGS. 1–4 the opener 10 comprises a single tubular member having an integrally formed first section 12, a second section 14, and a central handle section 16. The section 12 is as shown, formed to provide an oblong member 18. The latter is created by collapsing the tubular member along the section 12 so as to form a pair of facing parallel members 20 and 22. In the formation of the two facing members a ridge line 24, see FIG. 4, is formed between the handle section 16 and the second section 14. This is achieved in the process of creating the hollow chamber with the substantial parallel side members 20, 22. The tubular element from which the tool is formed is selected to be of a size such that when the oblong chamber 18 is formed it will be of a size adapted to receive a tab such as 26 on a flip top can. The sizing of the tubing and the resulting chamber and section 12 are such that the tab can readily enter the chamber 18, but will be retained therein for operation of the opener in such a manner as to cause the tab to depress the known prestressed section in the can top, to thus cause the opening of the can. The length of the section 14 and its two parallel members 22 and 20 are such as to permit a substantial portion of the tab or ring, if the latter is used, to enter the chamber so that a firm grip can be achieved.

At the opposite end of the opener, the second section 14 is seen to comprise a hook-like opening 28. This hook-type portion of the opener is adapted to cooperate with a can top as shown in FIG. 3. Should the flip top ring or tab break without opening of the can, the opener's second section can still be used to supply sufficient pressure to the prestressed section of the can so as to effect a proper opening.

This second section is also formed integrally with the central handle section 16 by deforming the central tubular member by pressing laterally against it. In this case, unlike that of section 12, the tubular member is pressed equally inwardly from opposite sides so as to form two relatively longitudinally central, facing, substantially parallel, members 32 and 34. In this case a pair of ridge lines 36 and 38 are formed in the compressing process. In this instance also the two opposite sides are brought into intimate contact throughout substantially their entire length to form a substantially solid extension from the tubular member. After being so formed the hook-like opening is formed. The latter is formed by cutting through the two opposed members 32 and 34. In so doing there is provided a ledge-like portion 40 extended inwardly from the end 42 a substantial portion of the length of the section 14, and an inner re-entrantly curved portion 44 which terminates as shown at 46 a substantial distance inwardly from the edge 42. It will be seen that this hook-like formation is suitable for engaging with the outer rim of a can top in such a manner that when the tool is forced upwardly as indicated by the arrow 48 in FIG. 3, the other edge 42 will be urged downwardly towards the can top as indicated by the line 50. When this occurs the peak 42 will engage the pressure sensitive section 54 in such a manner as to exert downward pressure on it, and force the latter to open.

FIGS. 5–9 show a second preferred form of the invention wherein the central handle section 56 is also provided with integral end sections 58 and 60. As with the embodiment illustrated in FIGS. 1–4, the sections 58 and 60 are formed by deforming the tubular member to provide the two tools integral with the handle 56. A simple readily available tubular section such as a tube of aluminum is used to form the multiple tool having the simple central handle. As shown there is provided the hook-like portion 62 at one end and the oblong chamber 64 at the opposite end.

It will be noticed that the multiple tool device has no sharp protruding edges which are apt to be caught upon clothing or other articles such as in a handbag. It also has a smooth surface, and has no projecting pins or recesses for the latter. It is of a single piece construction and embodies no elements that need to be swung relative to the handle section, or covered when not in use.

The multiple tool openers can be provided with small openings such as 66 and 68, whereby then may be hung from hooks or pins or the like.

It should be noted that the hook-like sections 28 and 62 extend inwardly a substantial distance from the edges 42 and 70 respectively.

The double use device is formed of a simple tubular member, it does not embody separate sections which have to be united, and it can be formed with relatively simple tooling. A handle of adequate size is provided between the two tools without any special dies or parts being required. Further, the whole has a pleasing overall appearance.

The combination tool can be made with central handle sections of various lengths. The latter section can in fact be reduced to substantially no more than the length of one of the tools, as shown in FIGS. 1–4, or even less. As a result a very small device can be provided for carrying in handbags or the like.

While I have shown and described preferred forms of the invention, it will be understood that other forms and variations can be devised within the scope of the invention and that accordingly the invention is to be limited only to the claims appended hereto.

I claim:

1. An opener for a can top having tabs or the like for opening the cans to which they are attached by mechanical action, comprising:

a hollow tubular member having a first section, a second section, and a hollow central handle section intermediate said first and said second sections;

said first section being formed integrally with said central handle section and being formed as a flattened portion of said tubular member extending outwardly from one end of said hollow central handle section to form a first pair of facing spaced substantially parallel members;

said second section being formed integrally with said central handle section and being formed as a flattened portion of said tubular member extending outwardly from a second end of said hollow central handle section;

the major portion of the opposing elements defining the wall of said first section portion of said hollow tubular member being parallel to each other and spaced from each other to form a relatively narrow oblong chamber therein, as contrasted with said central handle section;

said oblong chamber of said first section extending inwardly thereof towards said central handle section;

the major portion of the opposing elements defining the wall of said second flattened section being in intimate contact with each other to form a substantially flat solid extension from said central handle section, and forming a relatively rigid section as contrasted with said first section, and contrasted with said central handle section;

the opposing elements defining the wall of said central handle portion being all spaced a substantial distance from each other, as contrasted with the spacing of the opposing elements of the major portions defining the walls of said tubular member within said first and within said second sections, and forming a substantially hollow rotund central handle section of said opener;

the oblong chamber of said first section being formed to receive a flip top can tab sufficiently to operate the latter tab through rotation of said opener;

said second flattened section being provided with a hook-like recess for use in opening a can top;

said first section, said second section, and said central handle section being formed of a single piece of tubing;

said hook-like recess being formed by a flat ledge portion extending inwardly from the outer end of said flattened second section inwardly substantially parallel to the major axis of said tubular member;

said ledge portion merging into a re-entrantly curved portion terminating in a second flat ledge-like portion extending substantially parallel to the first;

said second ledge-like portion terminating inwardly from the latter said end a substantial distance; and the whole forming a hook-like indentation in said flattened section section for use in opening a can top.

2. The opener of claim 1, wherein:

said central handle section and said first section and said second section form a unitary seamless unit.

* * * * *